US005243794A

United States Patent [19]

Pikor

[11] Patent Number: 5,243,794

[45] Date of Patent: Sep. 14, 1993

[54] MODULAR CRYPT ASSEMBLY

[75] Inventor: Steven J. Pikor, Sterling Heights, Mich.

[73] Assignee: Christian Memorial Cultural Center, Rochester Hills, Mich.

[21] Appl. No.: 740,905

[22] Filed: Aug. 6, 1991

[51] Int. Cl.[5] ..... E04H 13/00

[52] U.S. Cl. ..... 52/136; 52/236.9; 52/79.9; 52/79.3

[58] Field of Search ..... 12/136, 137, 134, 236.8, 12/236.9, 79.14, 79.13, 79.3, 79.9

[56] References Cited

U.S. PATENT DOCUMENTS

| | | | |
|---|---|---|---|
| 3,287,865 | 11/1966 | Lockman | 52/136 |
| 3,744,200 | 7/1973 | Rice | 52/79.13 |
| 3,878,656 | 5/1975 | Duwe et al. | 52/136 |
| 3,958,378 | 5/1975 | Omechevarria | 52/136 |
| 4,048,772 | 9/1977 | Gaul | 52/136 |
| 4,068,420 | 1/1978 | Rice | 52/79.9 |
| 4,068,425 | 1/1978 | Czorniak | 52/236.8 |
| 4,073,100 | 2/1978 | DiGiovanni, Jr. | 52/136 |
| 4,989,382 | 2/1991 | Spronken | 52/136 |

FOREIGN PATENT DOCUMENTS

| | | |
|---|---|---|
| 0249306 | 12/1942 | France . |
| 1098435 | 7/1955 | France . |
| 2333112 | 11/1975 | France . |

*Primary Examiner*—Carl D. Friedman
*Assistant Examiner*—Winnie Yip
*Attorney, Agent, or Firm*—Basile and Hanlon

[57] ABSTRACT

The present invention is a modular multi-crypt assembly including a plurality of individual crypts. The assembly comprises a plurality of interconnected crypt modules wherein each module includes a plurality of tenons and mortises thereon for engaging corresponding mortises and tenons of adjacent modules to interconnect the modules into a solid multi-crypt assembly. The crypt modules have an inverted L configuration and are injection molded from a plastic material such as polyethylene.

33 Claims, 4 Drawing Sheets

MODULAR CRYPT ASSEMBLY

BACKGROUND OF THE INVENTION

1. Technical Field

The subject invention is a modular crypt assembly and more particularly a modular crypt assembly constructed from a plurality of interconnected crypt modules.

2. Description of the Related Art

Multiple crypt assemblies are typically formed in situ by providing appropriate forms and pouring concrete into the forms to form the multiple crypts. This procedure is expensive and time consuming. In an effort to provide multiple crypt assemblies in a less expensive manner, various module units have been devised. For example, multiple crypt assemblies have been formed from concrete modular units having inverted U or L configurations with the individual modules being stacked one on top of another and side by side to form multiple horizontal rows of crypts and a multiple vertical columns of crypts. While less expensive than the in situ constructions, multiple crypt assemblies constructed using these concrete modular units are still relatively expensive due to the high cost of forming the modules and because the modules, by virtue of their great weight, require a large number of laborers and material handling equipment to erect the assembly.

An example of such a modular crypt assembly is shown in U.S. Pat. No. 3,878,656 issued May 22, 1975 to Duwe. The Duwe '656 patent discloses a modular crypt assembly including a plurality of individual modules interconnected both laterally and vertically to one another.

Similar assemblies are shown in U.S. Pat. No. 3,287,865 issued Nov. 29, 1966 to Lockman, U.S. Pat. No. 4,048,772 issued Sep. 20, 1977 to Galul, U.S. Pat. No. 4,068,425 issued Jan. 17, 1978 to Kzorniak, U.S. Pat. No. 3,958,378 issued May 25, 1975 to Omeechevarria and French Patent 1,098,435 issued Jul. 26, 1955 to Narbona. All of these patents disclose modular concrete crypt assemblies including individual modules interconnected with one another to form a modular crypt assembly.

Due to the great weight of such concrete crypt modules, standard tongue and groove joints satisfactorily interconnect adjacent modules and prevent relative movement therebetween. Unfortunately, however, when lighter construction materials are substituted for concrete, e.g. plastics, standard tongue and groove joints do not adequately interconnect adjacent modules. That is, due to the light weight of the plastic materials, tongue and groove joints do not only lack the necessary strength, they do not adequately limit relative movement between adjacent modules. Thus, while lightweight crypt modules offer substantial cost reduction due to their relative ease of handling, they present unique problems with regard to their interconnection with one another.

SUMMARY OF THE INVENTION AND ADVANTAGES

The present invention is a modular crypt assembly including a plurality of individual crypts. The assembly comprises a plurality of interconnected crypt modules wherein each module includes a horizontal shelf having front and rear ends and first and second sides. A vertical leg depends downwardly from the first side of the shelf to a lower distal support and extends between fore and aft ends at the ends of the shelf. The assembly is characterized by the modules including a plurality of tenons and corresponding mortises extending therefrom, the tenons of the modules being disposed in the corresponding mortises of other modules so as to interconnect the modules to construct the assembly.

An advantage of interconnecting the individual crypt modules by disposing the tenons of one module into the mortises of another module is realized by a stronger, more rigid interconnection between modules.

BRIEF DESCRIPTION OF THE DRAWINGS

Other advantages of the subject invention will be readily appreciated as the same becomes better understood by reference to the following detailed description when considered in connection with the accompanying drawings wherein.

DETAILED DESCRIPTION OF THE PREFERRED EMBODIMENT

Figure 1:
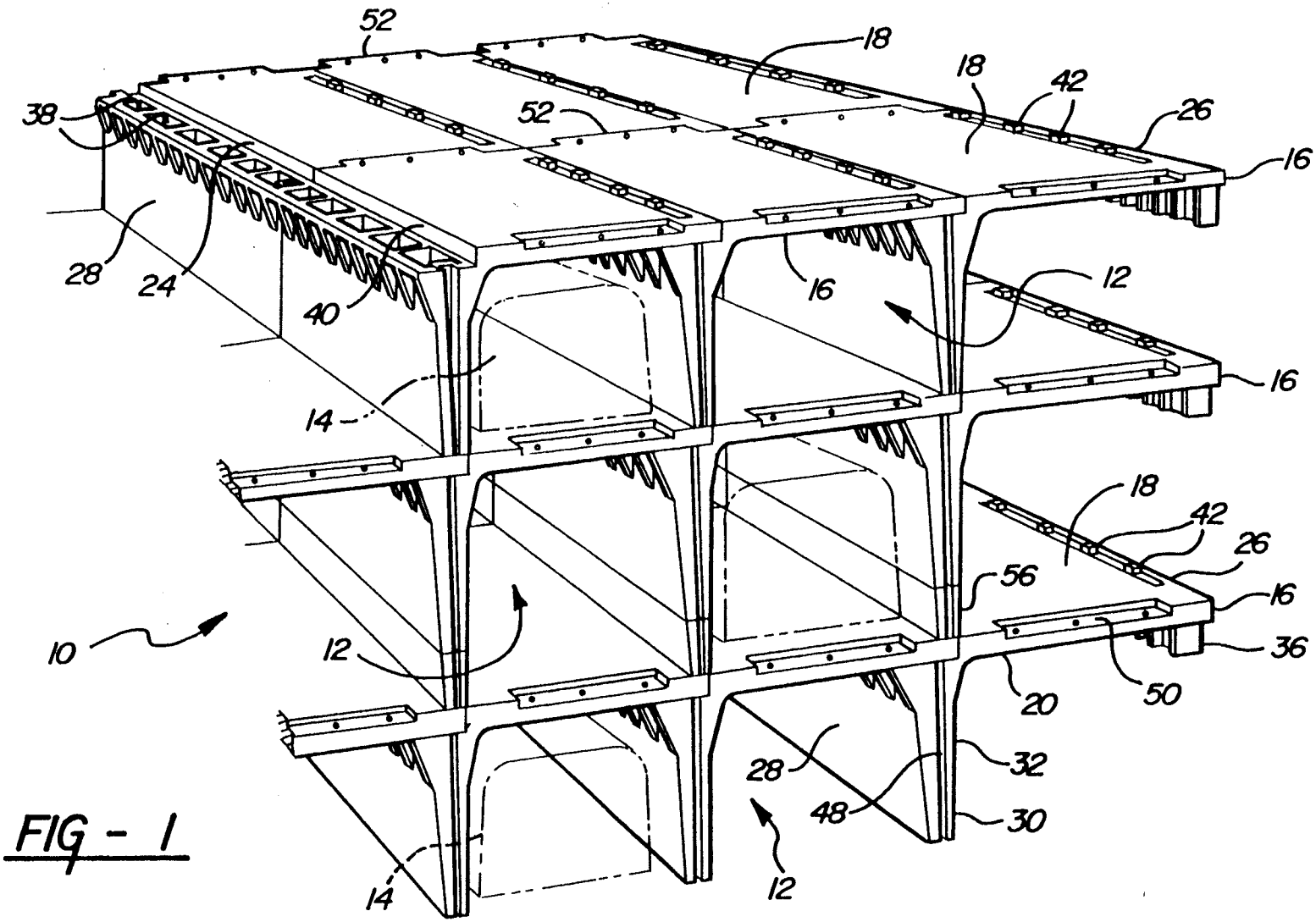
FIG. 1 is a perspective view of the subject modular crypt assembly showing a plurality of interconnected crypt modules.
Figure 2:
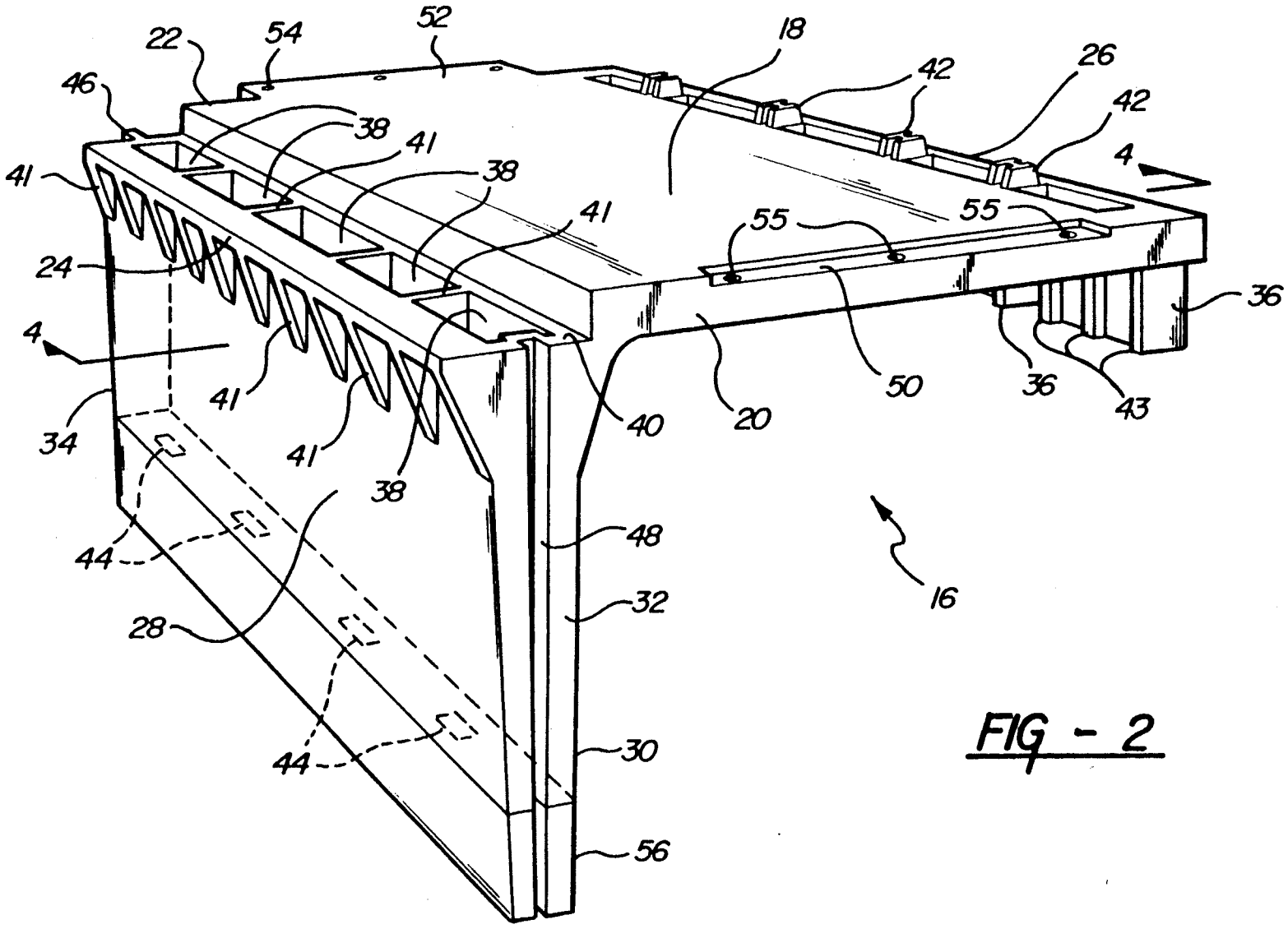
FIG. 2 is a perspective view of the subject crypt module.

The subject invention is a modular crypt assembly and is generally shown at 10 in FIG. 1. The assembly includes a plurality of individual crypts chambers 12 for receiving caskets 14 therein. The assembly 10 comprises a plurality of interconnected crypt modules 16 each having essentially an inverted "L" configuration. The individual crypt modules 16 may be interconnected laterally and longitudinally to form a planar surface and may be stacked upon one another thus forming vertical columns. As best shown in FIG. 2, each crypt module 16 includes a horizontal shelf 18 having a front 20 and rear 22 end and a first 24 and second 26 side. A vertical leg 28 depends downwardly from the first side 24 of the shelf 16 to a lower distal support 30 and extends between fore 32 and aft 34 ends at the ends 20, 22 of the shelf 18. Each module 16 additionally includes a plurality of tenons 36 or male projections and corresponding mortises 38 or female cavities extending therefrom. The tenons 36 of one module 16 are disposed in the corresponding mortises 38 of another module 16 so as to interconnect the modules 16 to construct assembly as generally shown at 10 in FIG. 1.

Turning to FIG. 2, an individual crypt module is generally shown at 16. The module 16 includes a plurality of tenons 36 extending downwardly from the shelf 18 along the second side 26 thereof and a plurality of mortises 38 extending downwardly from the first side 24 of the shelf 18 along the leg 28 for receiving the tenons 36 of a like module 16 to construct a row of laterally interconnected modules 16. The mortises 38 of each module 16 are located at a position lower than the shelf 18 so as to create a ledge 40. Partition members divide the individual mortises from one another and offer support the module 16. When the tenons 36 of a first module 16 are disposed within the mortises 38 of a second module 16, a portion of the under side of the shelf 18 of the first module 16 rest upon the ledge 40 of the second module 16 thus forming a planar surface along the upper portion of the shelves 18. The outer periphery of the mortises 38 abut against the partition members thus providing a secure fit between the mortises 38 and the tenons 36. An additional feature of the assembly 10 which adds to the secure fit between interconnected modules are the presence of support ridges 43 positioned vertically along the tenons 36 for fictionally engaging the inner surface of the mortises 38.

Preferably, the tenons 36 and mortises 38 are substantially rectangular in shape, but other polygonal as well as elliptical shapes may be used. Regardless of the particular shapes of the mortises 38 and tenons 36, a male-female interconnected therebetween is key. That is, although a specific shape or configuration is not required, a male-female interrelationship between the tenons 36 and mortises 38 is required.

The module 16 includes projections 42 extending upwardly from the shelf 18 along the second side 26 thereof. Recesses 44 are also included and extend vertically upwardly into the distal support 30 of the leg 28 for receiving the projections 42 of a like module 16 to construct a column of vertically interconnected modules 16. That is, the recesses 44 located along the distal support 30 of one module 16 receive the projections 42 of another module 16 thereby interconnecting the modules 16 in a vertical relationship (shown in FIG. 1). As with the tenons 36 and mortises 38, the projections 42 and recesses 44 are preferably substantially rectangular in shape but may be of any suitable shape.

The crypt modules 16 are preferable injection molded from polyethylene in order maximize strength while minimizing the cost of each module 16. While injection molding is the preferred method for making the modules 16, other techniques for molding or shaping may be utilized. Although polyethylene is the preferred material of construction, those skilled in the art will appreciate a wide range of suitable molding materials including polystyrene.

The length of each module 16 is half of the total length of the crypt. That is, two modules 16 are interconnected longitudinally in order to construct one crypt, as shown in FIG. 1. By using a module 16 half the length of the crypt, the quantity of material necessary to form the module 16 is reduced, thus the size and cost of the injection molding machinery can likewise be reduced.

In order to longitudinally interconnect like modules 16, the module 16 includes attachment means so as to achieve the overall length of the crypt. More specifically, the attachment means includes a tongue 46 extending vertically along the aft end 34 of the leg 28 and a corresponding groove 48 extending vertically along the fore end 32 of the leg 28 for receiving the tongue 46 of a like module 16 to construct a row of longitudinally interconnected modules 16 (shown in FIG. 1). As shown in FIG. 2, the tongue 46 and groove 48 are preferably tapered. That is, the widths of the tongue 46 and groove 48 are progressively narrowed as the tongue 46 and groove 48 extend toward the distal support 30. The taper of the tongue 46 and groove 48 provides a draft angle to assist in the removal of the module 16 from molding equipment.

The attachment means further includes a slot 50 extending horizontally along the front end 20 of the shelf 18 and a corresponding lip 52 extending horizontally along the rear end 22 of the shelf 18 for receiving the slot 50 of a like module 16 to construct a row of longitudinally interconnected modules 16. A locking means 54 is provided for locking the lip 52 into the slot 50 of a like module 16. The locking means 54 is preferably a threaded screw but any well known locking means such as adhesives, nut and bolt assemblies, etc. may be used. In the case in which threaded screws are used, apertures 55 are preferably positioned along the slot 50 for receiving the threaded screws.

Figure 4:
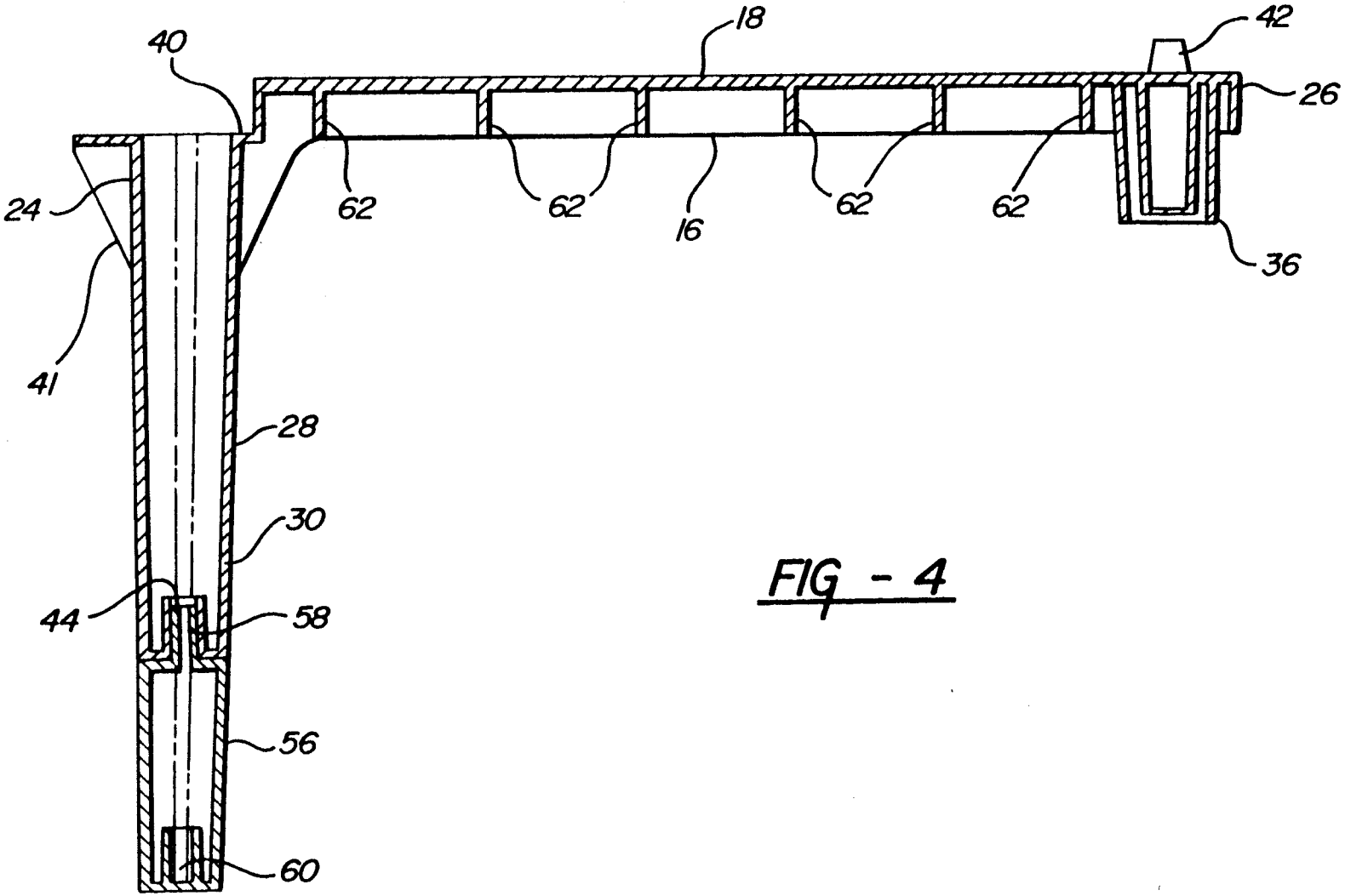
FIG. 4 is a cross-sectional view of the subject crypt module taken along line 4—4 of FIG. 2.

The height of the modules 16 may be increased by utilizing an extension 56 to extending the length of the legs 28. The subject extension 56, best shown in FIGS. 2 and 4 is essentially a rectangular member including at least one locator tenon 58 extending upwardly therefrom for engaging at least one of the recesses 44 in the distal support 30, in order to interconnect the extension 56 to the leg 28. Ideally the extension 56 includes the same number of locator tenons 58 as the module 16 includes projections 42. Also the locator tenons 58 are preferably of similar shape as the projections 42. The extension 56 also includes at least one niche 60 therein, opposite the locator tenon 58, for receiving the projection 42 of another module 16 thereby allowing modules 16 having extensions 56 thereon to be vertically interconnected with other modules.

In order to laterally and longitudinally interconnect the modules 16, thus forming a planar surface, it is preferred that all of the modules 16 of a particular row be of the same height. For example, FIG. 1 shows an assembly 10 wherein an upper and lower row are of the same height (no extensions 56) whereas the modules 16 of a middle planar row all include extensions 56. Although it is preferred that all of the modules 16 of a particular row be of the same height, it is not necessary that the extensions 56 be of the same height among different rows. For example, a row may include no extensions 56 while another row may include relatively short extensions 56 and still another row may include relatively long extensions 56. Thus, the height of the individual crypt chambers 12 may be enlarged to accommodate larger caskets 14.

Figure 3:
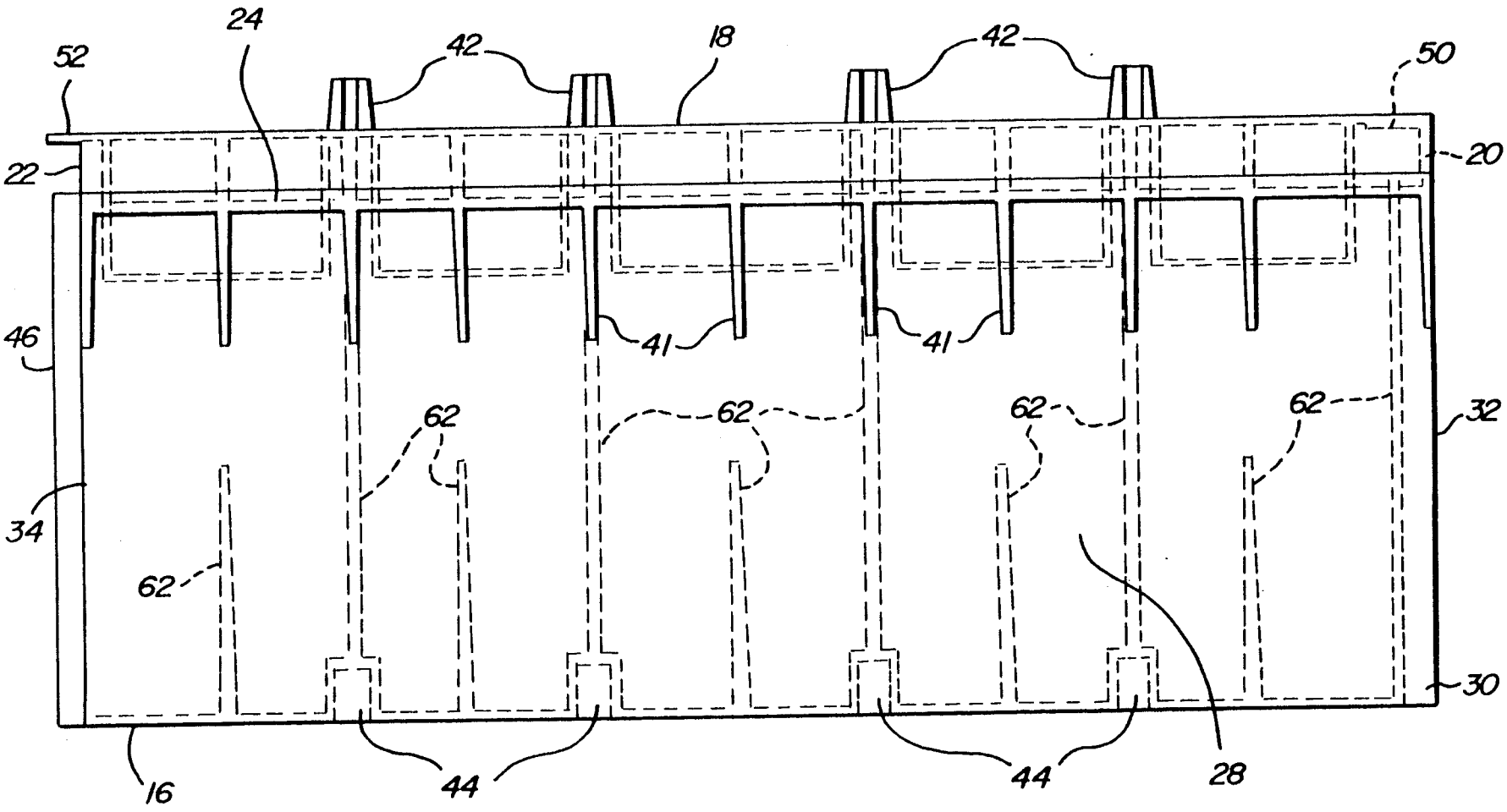
FIG. 3 is a side view of the subject crypt module.

In order to strengthen the assembly 10, reinforcement ribs 62 are positioned along the shelf 18 and leg 28 portions of the modules 16 (best shown in FIGS. 3 and 4) for reinforcing the module 16. The specific number and placement of the ribs 62 may vary with regard to the specific material utilized in the manufacture of the modules 16. The specific number and placement of the ribs 62 as shown in FIGS. 3 and 4 has been optimized with regard to strength and weight for polyethylene.

The crypt assembly 10 is easily constructed by laterally, longitudinally and vertically interconnecting individual crypt modules 16 together, thus forming a crypt assembly 10 of the desired size which can easily be expanded upon by simply adding additional modules 16. More specifically, a longitudinal row, preferable two modules 16 deep, is constructed by disposing the tongue 46 and lip 52 of one module 16 into the groove 48 and slot 50 of another module 16, respectfully. Once the lip 52 is positioned within the slot 50 a threaded screw member is preferably driven through both the slot 50 and lip 52 to secure the two to one another.

The interconnected longitudinal row of modules 16 is extended laterally by disposing the tenons 36 of the interconnected modules 16 into the mortises 38 of other modules 16 thus creating a planar row or level of modules 16, interconnected both laterally and longitudinally. The last module 16 of each lateral row is preferably supported by an additional insert leg (not shown), similar to the vertical leg 28 as previous described. The insert leg includes mortises for receiving the tenons 36 of the last module 16 and provides support for the module 16 and assembly 10.

Addition levels or vertical columns of modules 16 may be constructed by positioning modules 16 one on top of each other. More specifically, a vertical column of modules 16 may be constructed by positioning the projections 42 of a lower module 16 into the recesses 44 of an upper module 16. In the case in which an extension has been used, the projections 42 of a lower module 16 are disposed into the niches 60 of an upper module 16. A plurality of levels can be constructed by continually interconnecting the modules 16 of one level with one another and to the lever thereabove.

To complete the assembly 10, the crypts may be sealed with end caps (not shown). The end caps are positioned along the ends of the shelves 18 and legs 28 so as to seal the crypt chamber 12 from the outer environment. The end caps may be made from any suitable material and may include indicia thereon.

The invention has been described in an illustrative manner, and it is to be understood that the terminology which has been used is intended to be in the nature of words of description rather than limitation.

Obviously, many modifications and variations of the instant invention are possible in light of the above teachings. It is, therefore, to be understood that within the scope of the appended claims, the invention may be practiced otherwise than as specifically described.

What is claimed:

1. A modular crypt assembly including a plurality of individual crypts, said assembly comprising:

a plurality of interconnected crypt modules, each module including:

a horizontal shelf having front and rear ends and first and second sides, and a vertical leg depending downwardly from said first side of said shelf to define a lower distal support and extending between said front and rear ends of said shelf, said assembly characterized by said modules including a plurality of downwardly extending tenons from said second side thereof opposite to said leg and corresponding mortises extending downwardly from said first side along said leg and offset therefrom, said mortises having sidewalls defined by vertically extending tabs, said tenons of another module disposed within said corresponding mortises so as to interconnect said modules to construct a row of laterally interconnected modules.

2. A modular crypt assembly as set forth in claim 1 further characterized by said shelves of said laterally interconnected modules forming a planar surface.

3. A modular crypt assembly as set forth in claim 1 further characterized by said tenons and mortises being substantially rectangular.

4. A modular crypt assembly including a plurality of individual crypts, said assembly comprising:

a plurality of interconnected crypt modules, each module including;

a horizontal shelf having front and rear ends and first and second sides, and a vertical leg depending downwardly from said first side of said shelf to define a lower distal support and extending between said front and rear ends of said shelf, said assembly characterized by said modules including a plurality of tenons and corresponding mortises extending therefrom, said tenons of said modules being disposed in said corresponding mortises of other modules so as to interconnect said modules to construct said assembly, each module including said plurality of tenons extending downwardly from said shelf along said second side thereof opposite to said leg, and said plurality of mortises extending downwardly from said first side of said shelf along said leg, said tenons of another module disposed within said mortises for constructing a row of laterally interconnected modules, and each module including projections extending upwardly from said shelf along said second side thereof.

5. A modular crypt assembly as set forth in claim 4 further characterized by each module including recesses extending vertically upward into said distal support of said leg, said projections of another module disposed within said recesses to construct a column of vertically interconnected modules.

6. A modular crypt assembly as set forth in claim 5 further characterized by said projections and recesses being substantially rectangular.

7. A modular crypt assembly as set forth in claim 5 further characterized by each module including attachment means for longitudinally interconnecting like modules.

8. A modular crypt assembly as set forth in claim 7 further characterized by said attachment means including a tongue extending vertically along said rear end of said leg.

9. A modular crypt assembly as set forth in claim 8 further characterized by said attachment means further including a corresponding groove extending vertically along said front end of said leg, said tongue of one module disposed within said groove of another module to construct a row of longitudinally interconnected modules.

10. A modular crypt assembly as set forth in claim 9 further characterized by said tongue and groove being tapered.

11. A modular crypt assembly as set forth in claim 9 further characterized by said attachment means further including a slot extending horizontally along said front end of said shelf.

12. A modular crypt assembly as set forth in claim 11 further characterized by including a lip extending horizontally along said rear end of said shelf, said slot of one module disposed within said lip of another module to construct a row of longitudinally interconnected modules.

13. A modular crypt assembly as set forth in claim 12 further characterized by said attachment means including locking means for locking said lip into said slot of another module.

14. A modular crypt assembly as set forth in claim 12 further characterized by including extensions for extending the length of said legs.

15. A modular crypt assembly as set forth in claim 14 further characterized by said extensions including at least one locator tenon extending upwardly therefrom and disposed within at least one of said recesses in order to interconnect said extensions to said legs.

16. A modular crypt assembly as set forth in claim 15 further characterized by each extension including at least one niche extending into said extension opposite to said locator tenon and having said projection from another module disposed therein to interconnect said extensions to said shelves.

17. A modular crypt assembly as set forth in claim 12 further characterized by including reinforcement ribs along said legs and shelves for reinforcing said modules.

18. A crypt module of the type for laterally and vertically interconnecting with like modules to construct a modular crypt assembly, said module comprising:

a horizontal shelf having front and rear ends and first and second sides, and a vertical leg depending downwardly from said first side of said shelf to define a lower distal support and extending between said front and rear ends of said shelf, said module characterized by including a plurality of downwardly extending tenons from said second side thereof opposite to said leg and corresponding mortises extending downwardly from said first side along said leg and offset therefrom, for receiving said tenons of a like module to construct a row of laterally interconnected modules, said mortises having sidewalls defined by vertically extending tabs, said mortises adapted to receive said tenons of like modules for interconnecting like modules.

19. A module as set forth in claim 18 further characterized by said tenons and mortises being substantially rectangular.

20. A crypt module of the type for laterally and vertically interconnecting with like modules to construct a modular crypt assembly, said module comprising:

a horizontal shelf having front and rear ends and first and second sides, and a vertical leg depending downwardly from said first side of said shelf to define a lower distal support and extending between said front and rear ends of said shelf, said module characterized by including a plurality of tenons and corresponding mortises extending therefrom, said mortises adapted to receive said tenons of like modules for interconnecting like modules, each module including said plurality of tenons extending downwardly from said shelf along said second side thereof opposite to said leg, and said plurality of mortises extending downwardly from said first side of said shelf along said leg for receiving said tenons of a like module to construct a row of laterally interconnecting modules, and each module including projections extending upwardly from said shelf along said second side thereof.

21. A module as set forth in claim 20 further characterized by said module including recesses extending vertically upwardly into said distal support of said leg for receiving said projections of a like module to construct a column of vertically interconnected modules.

22. A module as set forth in claim 21 further characterized by said projections and recesses being substantially rectangular.

23. A module as set forth in claim 21 further characterized by said module including attachment means for longitudinally interconnecting like modules.

24. A module as set forth in claim 23 further characterized by said attachment means including a tongue extending vertically along said rear end of said leg.

25. A module as set forth in claim 24 further characterized by said attachment means further including a corresponding groove extending vertically along said front end of said leg for receiving said tongue of a like module to construct a row of longitudinally interconnected modules.

26. A module as set forth in claim 25 further characterized by said tongue and groove being tapered.

27. A module as set forth in claim 25 further characterized by said attachment means further including a slot extending horizontally along said front end of said shelf.

28. A module as set forth in claim 27 further characterized by including a lip extending horizontally along said rear end of said shelf for receiving said slot of a like module to construct a row of longitudinally interconnected modules.

29. A module as set forth in claim 28 further characterized by said attachment means including locking means for locking said lip into said slot of a like module.

30. A module as set forth in claim 28 further characterized by including an extension for extending the length of said leg.

31. A module as set forth in claim 30 further characterized by said extension including at least one locator tenon extending upwardly therefrom for engaging at least one of said recesses in order to interconnect said extension to said leg.

32. A module as set forth in claim 31 further characterized by said extension including at least one niche extending into said extension opposite to said locator tenon for receiving said projection from another module therein to interconnect said extension to said shelf of another module.

33. A module as set forth in claim 28 further characterized by including reinforcement ribs positioned along said shelf and leg for reinforcing said module

* * * * *